US006518695B2

(12) United States Patent
Lee

(10) Patent No.: US 6,518,695 B2
(45) Date of Patent: Feb. 11, 2003

(54) MASK-FRAME ASSEMBLY FOR CATHODE RAY TUBE

(75) Inventor: Hee Chul Lee, Kyongsangnam-do (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/399,862

(22) Filed: Sep. 21, 1999

(65) Prior Publication Data

US 2003/0001483 A1 Jan. 2, 2003

(30) Foreign Application Priority Data

Mar. 29, 1999 (KR) ..... 99-10733

(51) Int. Cl.[7] ..... H01J 29/81; H01J 29/82
(52) U.S. Cl. ..... 313/407; 313/402; 445/47
(58) Field of Search ..... 313/402, 403, 313/404, 405, 406, 407, 408; 445/47

(56) References Cited

U.S. PATENT DOCUMENTS 3,387,159 A * 6/1968 Schwartz et al. ..... 313/404
3,585,431 A * 6/1971 Long ..... 313/407
3,737,703 A * 6/1973 Tsuneta et al. ..... 313/407
3,772,555 A * 11/1973 McKee et al. ..... 313/404
3,936,691 A * 2/1976 Bakker et al. ..... 313/407
4,327,307 A * 4/1982 Penird et al. ..... 313/407
4,562,377 A * 12/1985 Kamohara et al. ..... 313/402
5,072,151 A * 12/1991 Spina ..... 313/407
5,686,784 A * 11/1997 Thoms et al. ..... 313/402
5,910,702 A * 6/1999 Maehara ..... 313/407
6,046,535 A * 4/2000 Jung ..... 313/402
6,111,346 A * 8/2000 Ito et al. ..... 313/402

* cited by examiner

*Primary Examiner*—Nimeshkumar D. Patel
*Assistant Examiner*—Karabi Guharay
(74) *Attorney, Agent, or Firm*—Robert E. Bushnell, Esq.

(57) ABSTRACT

A mask-frame assembly for a cathode ray tube includes a mask frame having a front portion and a side portion perpendicularly extending from the edge of the front portion and having notches, and a shadow mask having a front screen portion and a skirt portion welded to non-notched parts of the side portion of the mask frame. A portion of the skirt portion is not welded to the mask frame but exposed outside the mask frame so as to improve a thermal exchange.

18 Claims, 3 Drawing Sheets

MASK-FRAME ASSEMBLY FOR CATHODE RAY TUBE

BACKGROUND OF THE INVENTION

1. Field of the Invention

The present invention relates to a cathode ray tube and, more particularly, to a mask-frame assembly that can solve problems caused by a doming of a shadow mask of the cathode ray tube.

2. Description of the Related Art

Generally, a cathode ray tube is a display device that can display an image by the landing of electron beams, emitted from an electron gun, on phosphors formed on a face panel through a shadow mask.

The shadow mask is suspended inside the face panel by a mask frame. A mask-frame assembly is classified into two types depending on welding position of the shadow mask on the mask frame: a MIFA type and a MOFA type.

In the MIFA type, the shadow mask is welded on an outer surface of the mask frame, while in the MOFA type, the shadow mask is welded on an inner surface of the mask frame.

FIG. 3 shows a conventional mask-frame assembly.

A mask frame 2 comprises a front portion 6 which has an opening through which electron beams pass and a side portion 8, normal to the plane of the front portion 6, at the periphery of the front portion 6.

A shadow mask 10 can be welded on the inner or outer surface of the side portion 8 of the mask frame 2 as mentioned above.

The shadow mask 10 comprises a front screen portion 14 on which a plurality of electron beam converging apertures 12 are formed and a skirt portion 16 perpendicularly extending from the front screen portion 14. The curvature of a front screen portion is the same as the inner curvature of a face panel.

In the above described conventional mask frame assembly, it is well known that 15–18% of the electron beams pass through the apertures 12 of the shadow mask 10, while 82–85% strike the surface of the shadow mask 10.

The striking of the electron beams on the shadow mask 10 causes the shadow mask to be heated. As a result, doming of the shadow mask occurs, deteriorating color purity and white characteristics. Accordingly, the mask frame has been designed to compensate for the doming of a shadow mask.

However, this can not sufficiently solve the problems caused by doming. Particularly, when the mask-frame assembly is designed in the MIFA type, since the side portion of the mask frame restricts the thermal expansion of the skirt portion of the shadow mask, the problems caused by doming are worse.

Furthermore, in case of the large-screen cathode ray tube, i.e., more than 25 inches diagonally, deterioration of display quality caused by doming is more serious.

SUMMARY OF THE INVENTION

The present invention has been made in an effort to solve the above problems.

It is an objective of the present invention to provide a mask frame assembly that can improve display quality of a cathode ray tube by rapidly transmitting heat throughout a shadow mask.

To achieve the above objective, the present invention provides a mask-frame assembly for a cathode ray tube comprising a mask frame having a front portion and a side portion perpendicularly extending from the edge of the front portion and having notches, and a shadow mask having a front screen portion and a skirt portion welded to non-notched parts of the side portion of the mask frame.

The skirt portion of the shadow mask has indents at locations corresponding to the non-notched parts of the mask frame.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF PREFERRED EMBODIMENTS

A preferred embodiment of the present invention will now be described in detail with reference to the accompanying drawings.

Figure 1:
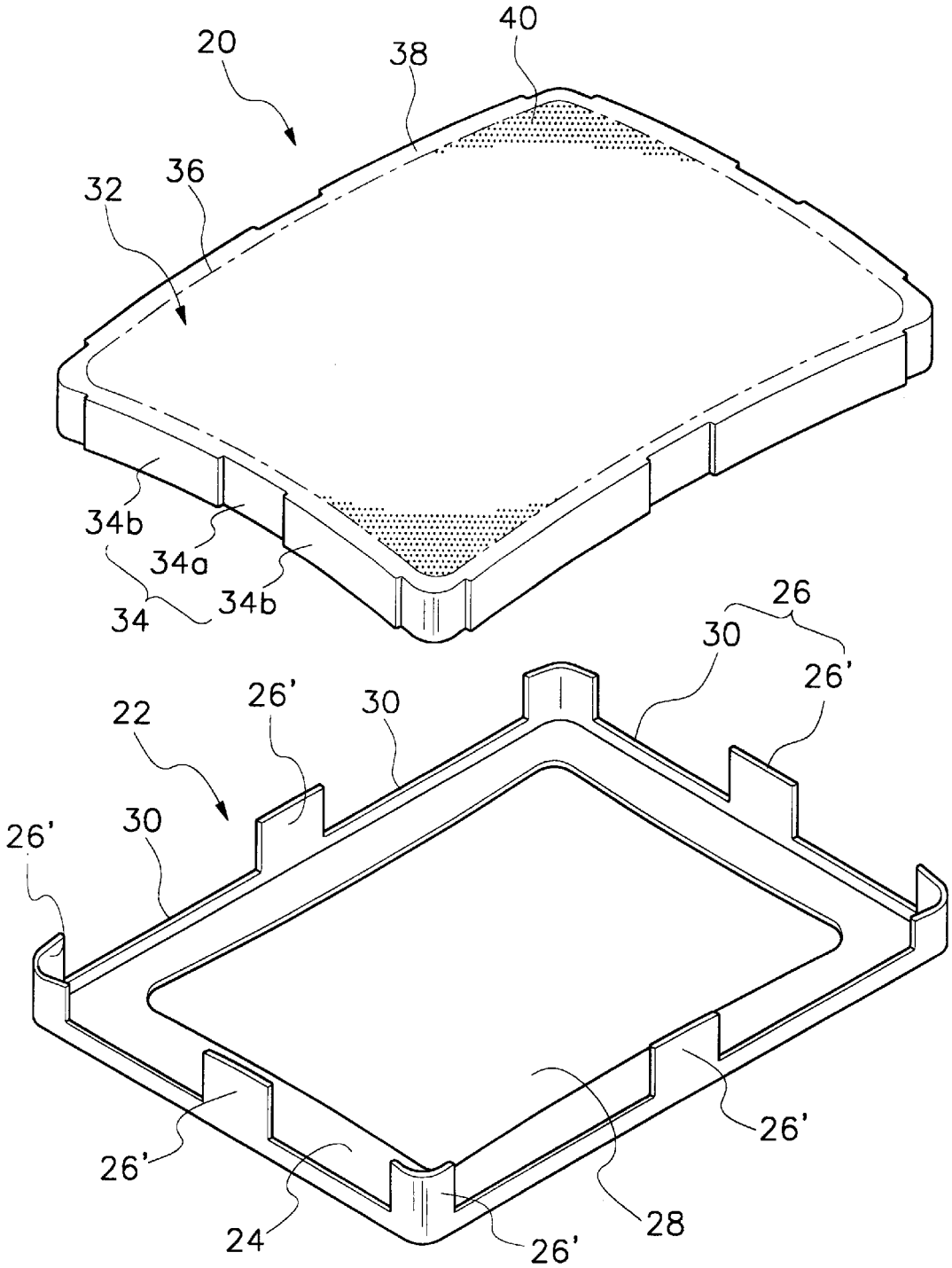
FIG. 1 is an exploded perspective view of a mask-frame assembly according to a preferred embodiment of the present invention.
Figure 2:
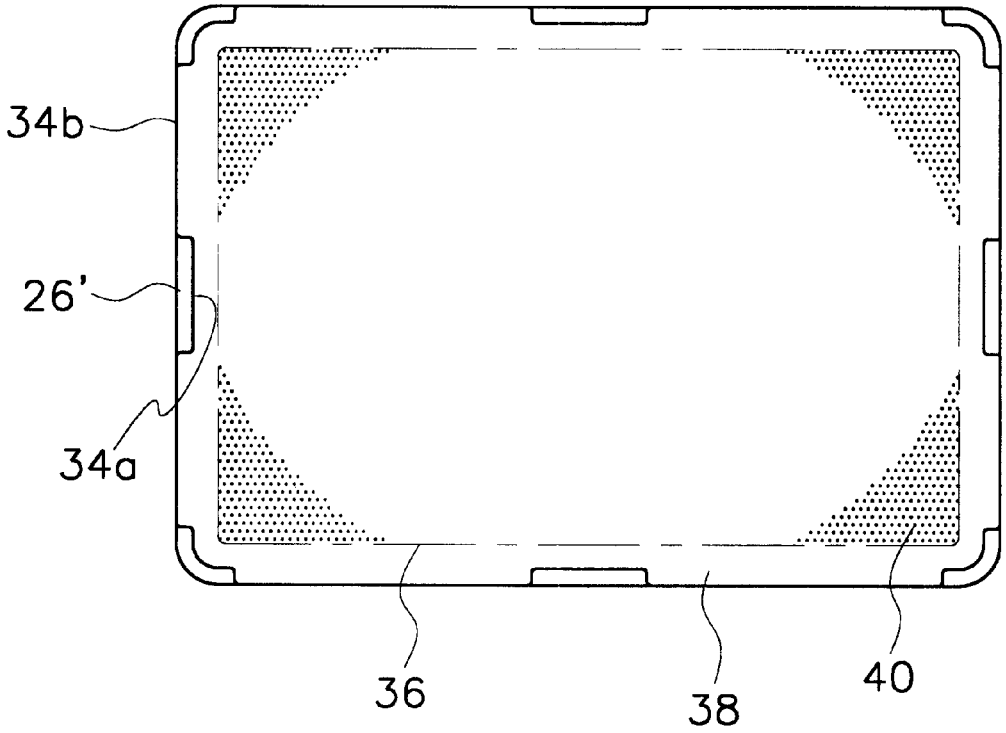
FIG. 2 is a plane view of the mask-frame assembly depicted in FIG. 1 when it is assembled.
Figure 3:
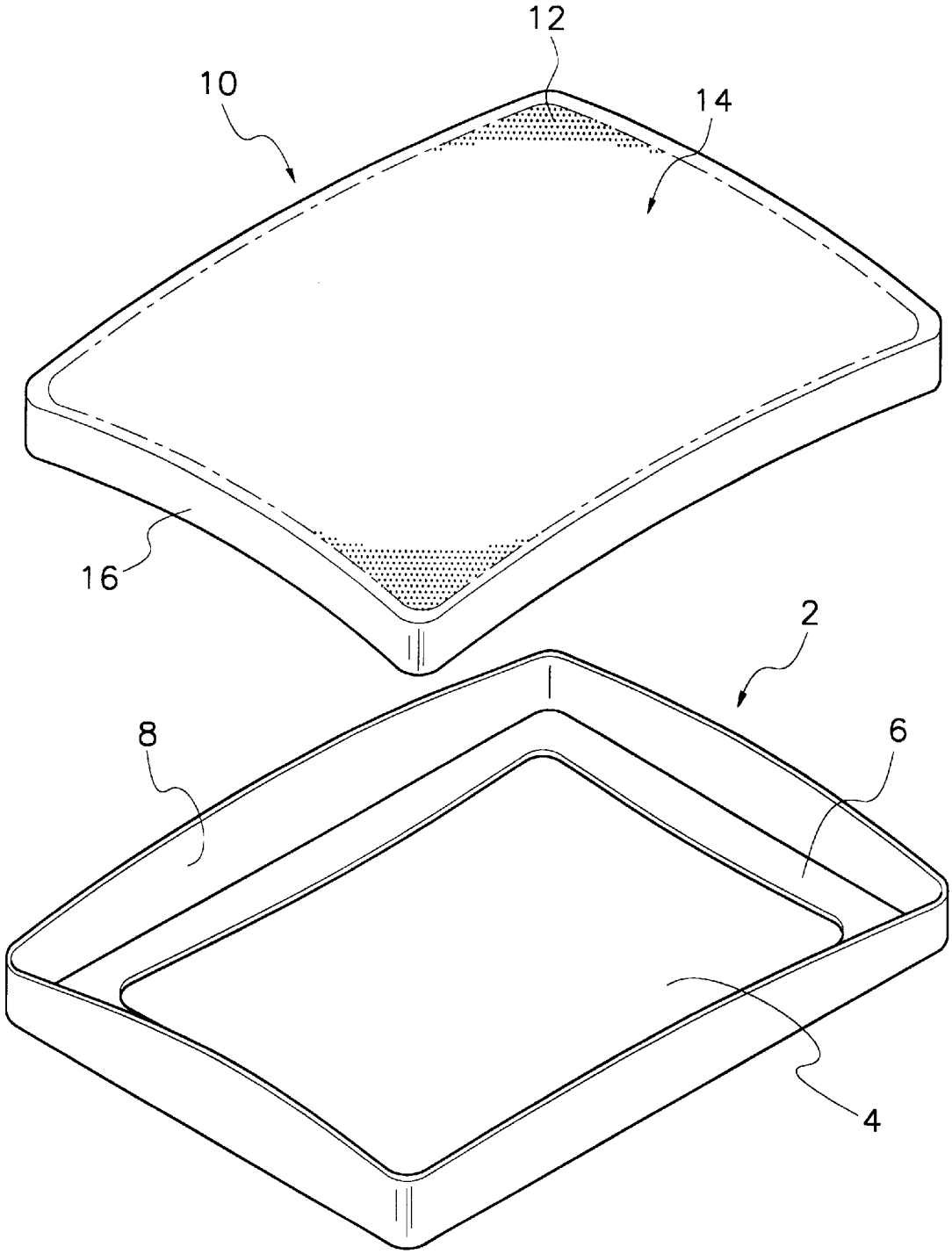
FIG. 3 is an exploded perspective view of a conventional mask-frame assembly.

FIG. 1 shows a mask-frame assembly according to a preferred embodiment of the present invention.

As shown in the drawing, the inventive mask-frame assembly comprises a mask frame 22 and a shadow mask 20 welded to the mask frame 22. The mask frame 22 comprises a rectangular front portion 24 and a side portion 26 perpendicularly extending from the edge of the rectangular front portion 24.

An electron beam passing opening 28 is formed in the rectangular front portion 24 of the mask frame 22, and a plurality of notches 30 are defined on the side portion 26. The notches 30 are formed by cutting away parts of the side portion 26 on each side except for at the corner and at the middle.

Accordingly, only the middle portions and corners of the side portion 26 remain. The remaining portions 26' are welded to the shadow mask 20.

The shadow mask 20 comprises a front screen portion 32 having a curvature identical to that of an inner surface of a face panel (not shown) and a skirt portion 34 vertically extending from the front screen portion 32.

The front screen portion 32 includes an aperture portion 36 on which a plurality of apertures 40 are formed and electron beams emitted from an electron gun (not shown) strike, and a non-aperture portion 38 formed on an outer portion of the aperture portion 36.

The skirt portion 34 is provided with a plurality of indented portions 34*a* on locations corresponding to the remaining portion 26'. That is, the remaining portion 26' of the mask frame 22 are welded on the indented portions 34*a* of the skirt portion 34, while non-indented portions 34*b* of the skirt portion 34 are fitted in the opening portions 30 of the side portion 26.

In the above-described mask-frame assembly of the present invention, when 82–85% of the electron beams emitted from the electron guns strikes the front screen portion 32 of the shadow mask 20, the front screen portion 32 is heated, and then the heat is gradually transmitted to the skirt portion 34.

At this point, since the non-indented portions 34*b* of the shadow mask 20 are not welded to the mask frame 22, the heat transmitted to the skirt portion 34 can be dissipated at a faster rate because the greater part of the skirt portion 34 of the shadow mask 20 is exposed to the air rather than welded to the mask frame 22.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A mask-frame assembly for a cathode ray tube, the assembly comprising:

a mask frame having a front portion and a side portion, the side portion perpendicularly extending from an edge of the front portion and having notches and non-notched parts, the notches being formed by removing a plurality of sections of the side portion at positions spaced apart from corner areas of the side portion; and a shadow mask having a front screen portion and a skirt portion, the skirt portion having indented portions and non-indented portions, the indented portions being located at positions corresponding to the corner areas of the mask frame and being located at positions corresponding to the non-notched parts of the mask frame.

2. An apparatus, comprising:

a mask frame for a cathode ray tube, said mask frame having a front portion and four side portions, said side portions extending from said front portion, each one of said side portions forming at least two notches separated by at least one non-notched part, each of said notches being formed when a part of said side portions is removed from said mask frame; and a shadow mask having a front screen portion and a skirt portion, said skirt portion having a plurality of indented portions and non-indented portions, each pair of said indented portions being separated by one of said non-indented portions, said indented portions being located at positions corresponding to said non-notched parts of said side portions of said mask frame, said non-indented portions being received by said notches.

3. The apparatus of claim 2, each of said side portions forming exactly two notches.

4. The apparatus of claim 2, said skirt portion of said shadow mask having four comers, said mask frame having four corners, each of said corners of said shadow mask corresponding to one of said indented portions, each one of said corners of said mask frame corresponding to one of said non-notched parts.

5. The apparatus of claim 4, said indented portions being welded to said non-notched parts.

6. The apparatus of claim 2, said indented portions being welded to said non-notched parts.

7. The apparatus of claim 2, said front screen portion forming a plurality of apertures.

8. The apparatus of claim 2, said non-indented portions being not welded to said mask frame.

9. The apparatus of claim 8, said non-indented portions of said skirt portion being larger than said indented portions of said skirt portion.

10. A mask-frame assembly for a cathode ray tube, the assembly comprising:

a mask frame having a front portion and a side portion perpendicularly extending from an edge of the front portion, the side portion having notches and having non-notched parts, each of the notches being formed by removing part of the side portion from the mask frame; and a shadow mask having a front screen portion and a skirt portion, the skirt portion having indented portions and non-indented portions, the indented portions being located at positions corresponding to the locations of the non-notched parts, the non-indented portions being located at positions corresponding to the locations of the notches.

11. The assembly of claim 10, the notches being formed by cutting away part of the side portion from the mask frame.

12. The assembly of claim 10, the non-indented portions being not welded to the mask frame.

13. The assembly of claim 10, the indented portions being welded to the non-notched parts.

14. The assembly of claim 13, the non-indented portions being not welded to the mask frame.

15. The assembly of claim 10, an exterior of the non-indented portions being flush with an exterior of the non-notched parts.

16. The assembly of claim 10, the notches being formed by making an opening completely through the side portion of the mask frame.

17. The assembly of claim 16, the non-indented portions being larger than the indented portions.

18. The assembly of claim 10, the non-indented portions being larger than the indented portions.

* * * * *